US006499460B2

(12) United States Patent
Suzuki et al.

(10) Patent No.: US 6,499,460 B2
(45) Date of Patent: Dec. 31, 2002

(54) IGNITION TIMING CONTROL DEVICE FOR INTERNAL COMBUSTION ENGINE

(75) Inventors: Makoto Suzuki, Saitama (JP); Tadashi Umeda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/827,373

(22) Filed: Apr. 6, 2001

(65) Prior Publication Data

US 2002/0038655 A1 Apr. 4, 2002

(30) Foreign Application Priority Data

Apr. 7, 2000 (JP) ..... 2000-105877

(51) Int. Cl.[7] ..... F02P 15/02
(52) U.S. Cl. ..... 123/310; 123/638
(58) Field of Search ..... 123/305, 310, 123/309, 406.23, 406.24, 406.32, 406.35, 406.59, 406.64, 406.49, 406.67, 406.68, 638

(56) References Cited

U.S. PATENT DOCUMENTS 4,116,179 A * 9/1978 Nagumo et al. ..... 123/310
4,116,180 A * 9/1978 Hayashi et al. ..... 123/310
4,116,181 A * 9/1978 Nakajima et al. ..... 123/310
4,144,860 A * 3/1979 Muranaka et al. ..... 123/310
4,243,005 A * 1/1981 Hisatomi ..... 123/179.5
4,421,081 A * 12/1983 Nakamura et al. ..... 123/310
4,432,315 A * 2/1984 Morita et al. ..... 123/193.5
4,452,198 A * 6/1984 Berland ..... 123/310
5,259,357 A * 11/1993 Shimizu et al. ..... 123/638
5,954,024 A * 9/1999 Duhr et al. ..... 123/310
6,295,966 B1 * 10/2001 Ishii ..... 123/339.11

FOREIGN PATENT DOCUMENTS

JP 6-323230 11/1994

* cited by examiner

*Primary Examiner*—Tony M. Argenbright
*Assistant Examiner*—Hai Huynh
(74) *Attorney, Agent, or Firm*—Arent Fox Kintner Plotkin & Kahn

(57) ABSTRACT

An engine operating region in which two ignition plugs ignite at different ignition timings is restricted to a region (phase-difference ignition region) where the effect of different ignition timings is remarkably achieved. In the operating region other than the above region, simultaneous ignition is performed. A basic ignition timing IGMAPIN of the intake ignition plugs 8I is calculated by searching a map (S11). In the phase-difference ignition region, a basic ignition timing IGMAPEX of exhaust ignition plugs 8E is calculated by searching a map (S13). By contrast, in the operating region where simultaneous ignition is to be performed, the basic exhaust ignition timing IGMAPEX is set as the basic intake ignition timing IGMAPIN (S14).

3 Claims, 5 Drawing Sheets

FIG. 3
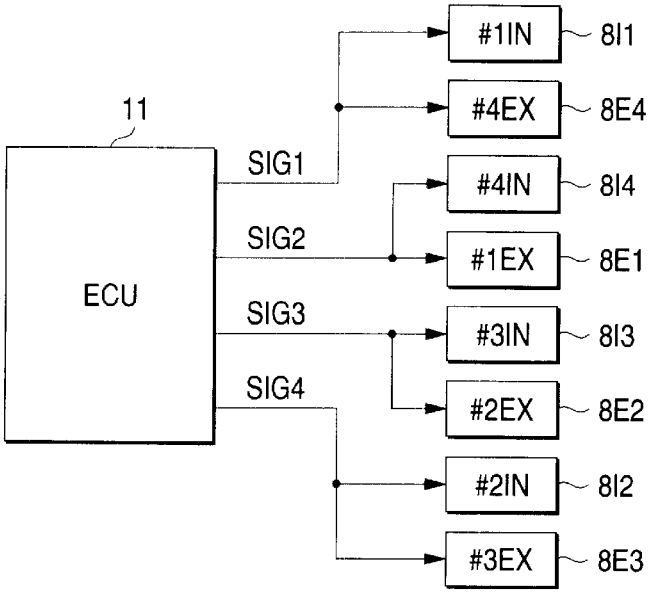
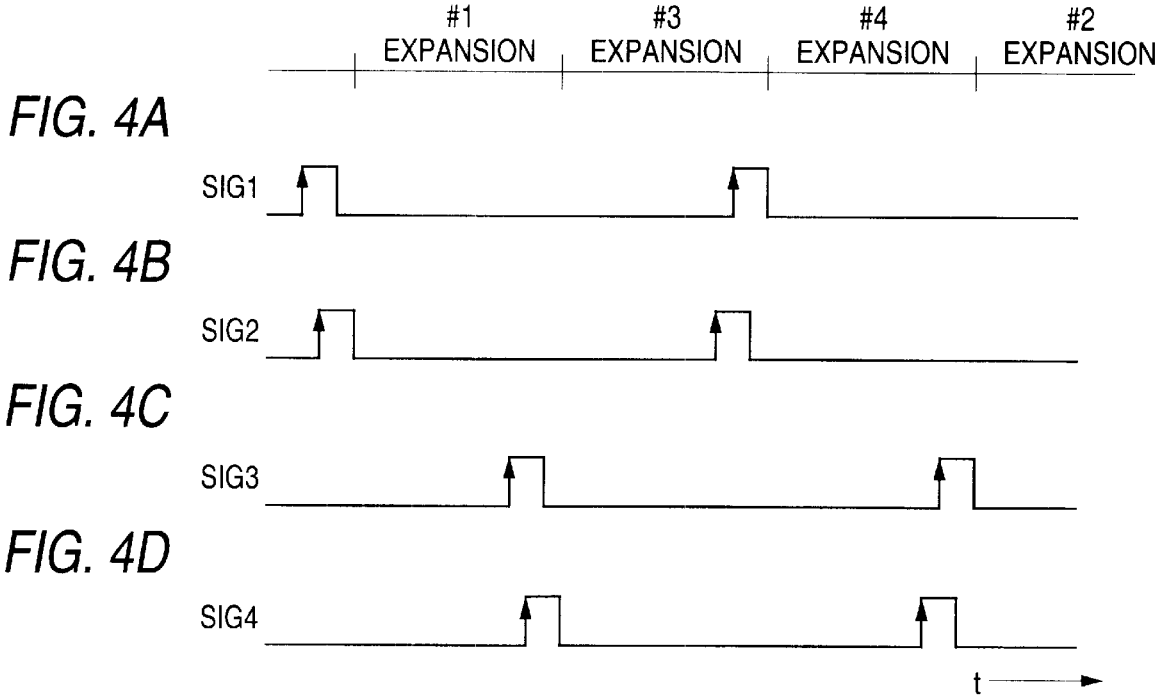

IGNITION TIMING CONTROL DEVICE FOR INTERNAL COMBUSTION ENGINE

BACKGROUND OF THE INVENTION

1. Field of the Invention

The present invention relates to an ignition timing control device for an internal combustion engine in which two ignition plugs are disposed for each cylinder.

2. Description of the Related Art

Conventionally, an ignition timing control system, for example, as shown in Japanese Patent Unexamined Publication No. Hei. 6-323230, in which a plurality of ignition plugs are disposed for each cylinder of an internal combustion engine, and the ignition timings of the ignition plugs are made different from each other to improve exhaust emission characteristics is known. In this system, in order to reduce the load on a calculation unit in the case where the ignition timings of the plural ignition plugs are determined in accordance with the operation state of the engine. On the other hand, a calculation for determining normal ignition timing with respect to specific ignition plug(s) is performed, and, with respect to the other ignition plug(s), the ignition timing is determined by a relatively simple calculation expression in accordance with the ignition timing of the specific ignition plug(s).

In an internal combustion engine in which each cylinder has a plurality of ignition plugs, however, it is not always necessary to make ignition timings of the ignition plugs different from one another in all of operation states of the engine. From the viewpoint of reduction of the calculation load on the calculation unit, therefore, there is room for further improvement.

SUMMARY OF THE INVENTION

The invention has been conducted in view of the problem. It is an object of the invention to provide an ignition timing control device for an internal combustion engine in which two ignition plugs are disposed for each cylinder, can control more adequately ignition timings of the ignition plugs to reduce the load on a calculation unit, and effectively realize suppression of knocking and vibration noises.

In order to attain the object, according to a first aspect of the invention, an ignition timing control device for an internal combustion engine controls ignition timing of an internal combustion engine. Here, in the internal combustion engine, two ignition plugs that perform at least one igniting operation in one cycle are disposed on an diagonal line of a combustion chamber of each cylinder. The two ignition plugs ignite at different ignition timings in predetermined operating region which is determined on the basis of a rotational speed and load of the engine, and ignite at a same ignition timing in an operating region other than the predetermined operating region.

According to this configuration, in the predetermined operating region which is determined on the basis of the rotational speed and load of the engine, the two ignition plugs ignite at different ignition timings. While, in the operating region other than the predetermined operating region, the ignition plugs ignite at the same ignition timing. In this case, the predetermined operating region is restricted to a region where the effect of the setting of different ignition timings is remarkably achieved. Therefore, the load on a calculation unit and the memory capacity can be reduced. In the predetermined operating region, an excellent effect of suppressing knocking and vibration noises can be attained by the setting of different ignition timings.

The predetermined operating region is preferably set to an operating region where the engine rotational speed is in a region between predetermined upper and lower limits and the engine load is equal to or larger than a predetermined load. By the way, each of the cylinders of the engine can be divided into an intake side and an exhaust side by a plane that is substantially perpendicular to a direction along which an intake port connected to the combustion chamber of the cylinder elongates. Here, the plane contains a center line of the cylinder, preferably, the two ignition plugs are placed in the intake side and the exhaust side, respectively.

BRIEF DESCRIPTION OF THE DRAWINGS

FIG. 3 is a diagram showing connections between an electronic control unit (ECU) and the ignition plugs of the cylinders;

FIG. 4 is a time chart illustrating ignition timings in the configuration of FIG. 3;

DETAILED DESCRIPTION OF THE PREFERRED EMBODIMENT

Hereinafter, an embodiment of the invention will be described with reference to the accompanying drawings.

Figure 1:
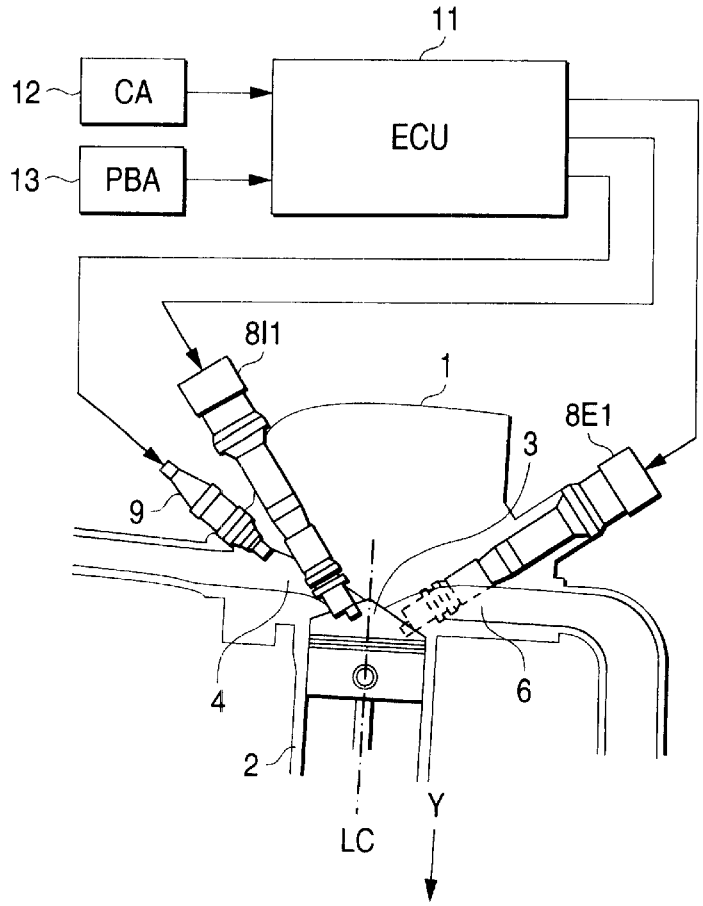
FIG. 1 is a diagram showing the configuration of main portions of an internal combustion engine and a control device therefor according to an embodiment of the invention.

FIG. 1 is a diagram showing the configuration of main portions of an internal combustion engine and a control device therefor according to an embodiment of the invention.

Figure 2:
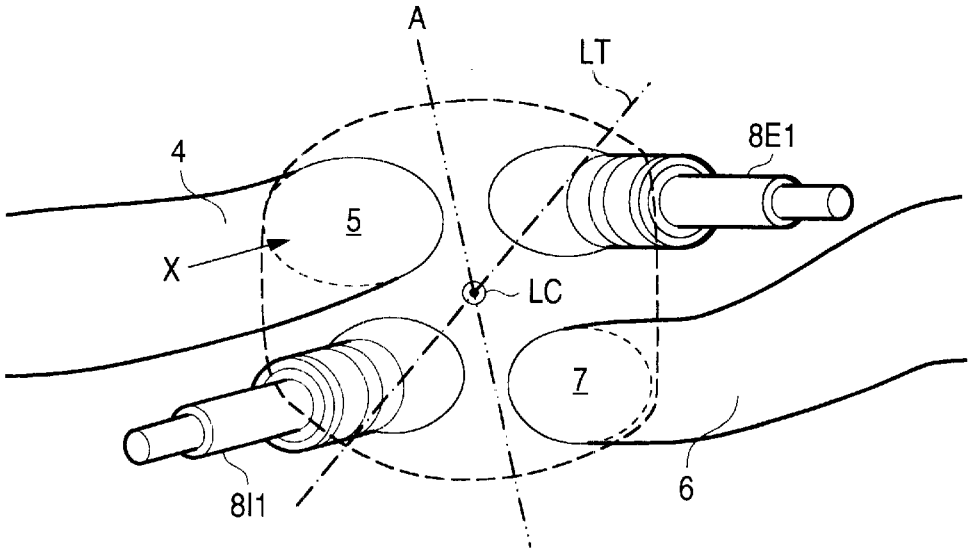
FIG. 2 is a view illustrating the arrangement of ignition plugs in each of cylinders in the internal combustion engine.

In a four-cylinder internal combustion engine (hereinafter, referred to merely as "engine") 1, each of the cylinders 2 has two ignition plugs. FIG. 2 is a view as seeing from the upper side of the cylinder 2, and illustrating the configuration of main portions. In the figure, an intake valve, an exhaust valve, and the like are not shown. The description will be done with reference to FIGS. 1 and 2, and taking #1 cylinder as an example. An intake port 4 is connected to a combustion chamber 3 via an intake opening 5, and an exhaust port 6 is connected to the combustion chamber 3 via an exhaust opening 7. The combustion chamber 3 is divided by an plane A into two portions. When the portion containing the intake opening 5 is referred to as the intake side and that containing the exhaust opening 7 is referred to as the exhaust side, the two ignition plugs 8I1 and 8E1 are placed on an diagonal line LT of the combustion chamber 3. Here, the two ignition plugs 8I1 and 8E1 are respectively attached to an upper portion of the combustion chamber on the intake side, and an upper portion of the combustion chamber on the exhaust side. The diagonal line LT is a linear line which intersects with the center line LC elongating in the axial direction Y of the cylinder 2, and which is perpendicular to the center line LC. The plane A is substantially perpendicular to a direction X along which the intake port 4 elongates, as seeing the cylinder 2 in the axial direction Y. The plane A contains the center line LC elongating in the axial direction Y of the cylinder 2. Also #2 to #4 cylinders are similarly configured.

In the following description, all the ignition plugs are generally referred to as "ignition plugs 8", the ignition plugs on the intake side are generally referred to as "intake ignition plugs 8I", and the ignition plugs on the exhaust side are generally referred to as "exhaust ignition plugs 8E".

The intake ignition plug 8I1 and the exhaust ignition plug 8E1 are connected to an electronic control unit (hereinafter, abbreviated to "ECU") 11 so that their operations are controlled by the ECU 11.

A crank angle position sensor 12 which detects the rotation angle of a crank shaft (not shown) of the engine 1 is connected to the ECU 11 to supply a signal corresponding to the rotation angle of the crank shaft. The crank angle position sensor 12 is configured by: a cylinder judging sensor which outputs a signal pulse (hereinafter, referred to as "CYL signal pulse") at a predetermined crank angle position of a specific one of the cylinders of the engine 1; a TDC sensor which outputs a TDC signal pulse at a crank angle position (in a four-cylinder engine, at an interval of 180 deg.) which leads a predetermined crankangle for the top dead center (TDC) at the start of the intake stroke in each cylinder; and a CRK sensor which generates one pulse (hereinafter, referred to as "CRK signal pulse") in a cycle of a constant crank angle (for example, in a cycle of 30 deg.) which is shorter than the TDC signal pulse. The CYL signal pulse, the TDC signal pulse, and the CRK signal pulse are supplied to the ECU 11. The signal pulses are used for controlling various timings such as the fuel injection timing and the ignition timing, and detecting the number of revolutions of the engine (the engine rotational speed) NE.

Furthermore, an intake pipe absolute pressure sensor 13 which detects the absolute pressure PBA of the downstream from a throttle valve of the intake pipe that communicates with the intake port 4 (hereinafter, the pressure is referred to as "inlet pipe absolute pressure"). And, other sensors (an intake-air temperature sensor, an engine cooling water temperature sensor, and the like) which are not shown are connected to the ECU 11. Detection signals of these sensors are supplied to the ECU 11.

A fuel injection valve 9 is disposed in the intake port 4. The operation of the valve is controlled by the ECU 11.

In accordance with the detection signals of the various sensors, the ECU 11 controls the ignition timings of the ignition plugs 8, and the opening time and timing of the fuel injection valve 9.

In the embodiment, a method in which two ignition plugs simultaneously ignite is employed. Therefore, the ignition plugs of #1, #2, #3, and #4 cylinders are connected to the ECU 11 as shown in FIG. 3. Specifically, the intake ignition plug 8I1 of #1 cylinder and the exhaust ignition plug 8E4 of #4 cylinder are driven by an ignition signal SIG1. Similarly, the exhaust ignition plug 8E1 of #1 cylinder and the intake ignition plug 8I4 of #4 cylinder are driven by an ignition signal SIG2, the intake ignition plug 8I3 of #3 cylinder and the exhaust ignition plug 8E2 of #2 cylinder are driven by an ignition signal SIG3, and the exhaust ignition plug 8E3 of #3 cylinder and the intake ignition plug 8I2 of #2 cylinder are driven by an ignition signal SIG4.

FIG. 4 is a time chart illustrating the ignition timings based on the ignition signals SIG1 to SIG4. The igniting operation is performed at the timing of each upward arrow in the figure. As shown in (a) and (b) of FIG. 4, ignition is conducted immediately before the expansion stroke of #1 cylinder and that of #4 cylinder in response to the ignition signals SIG1 and SIG2. And, as shown in (c) and (d) of the figure, ignition is conducted immediately before the expansion stroke of #3 cylinder and that of #2 cylinder in response to the ignition signals SIG3 and SIG4.

Figure 5:
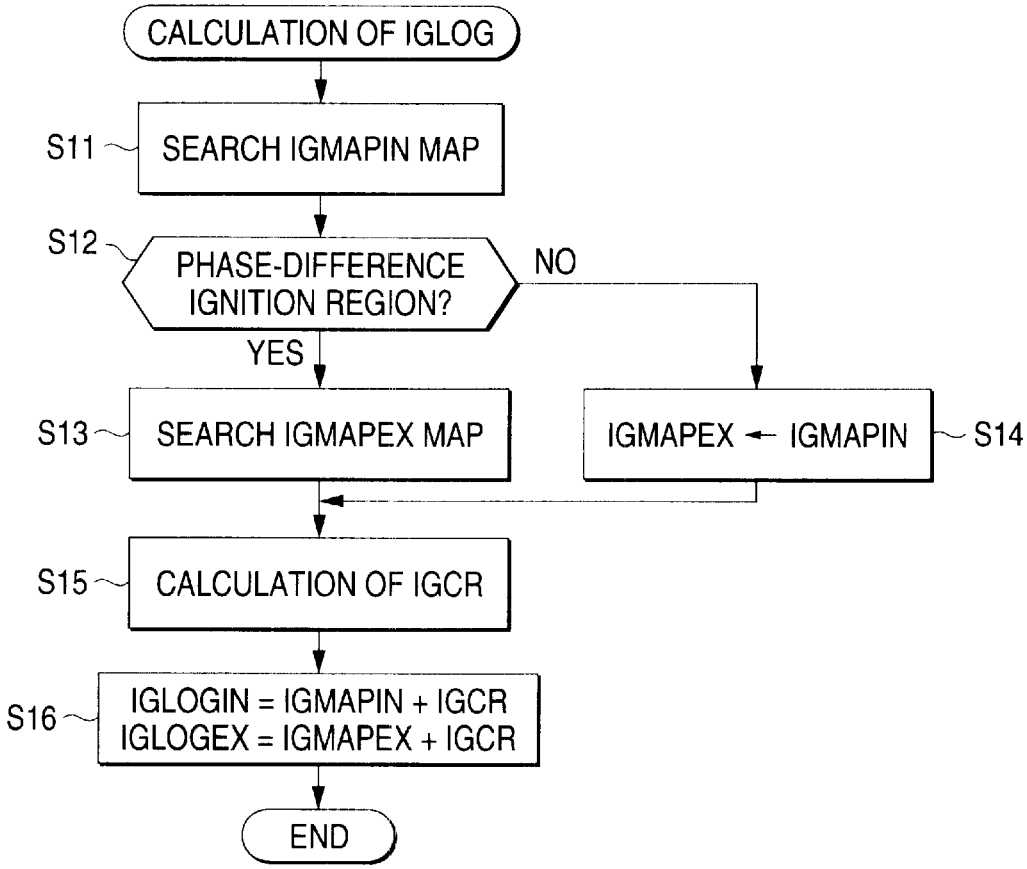
FIG. 5 is a flowchart of a process of calculating the ignition timings.
Figure 6:
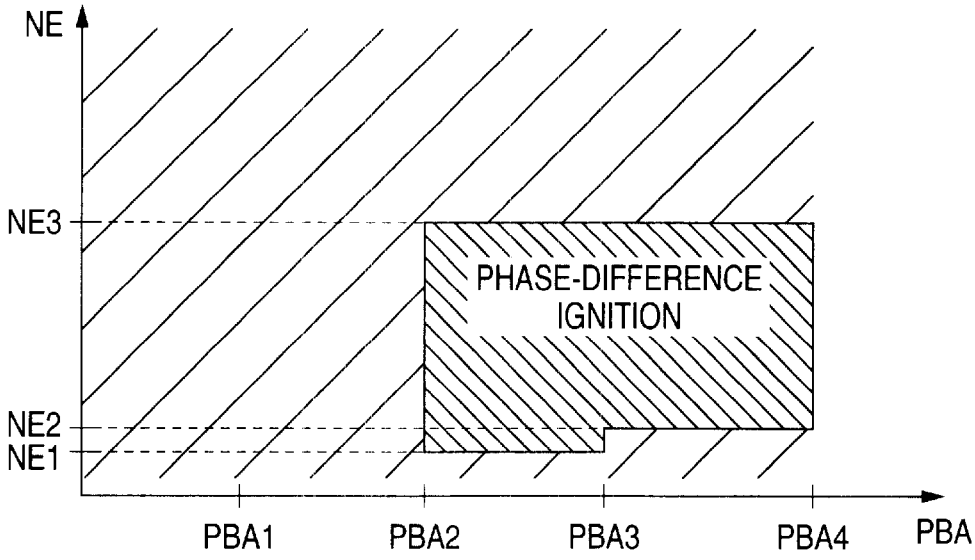
FIG. 6 is a view illustrating setting of the ignition timings according to the operation range of the engine.

FIG. 5 is a flowchart of a process of calculating the ignition timings of the ignition plugs 8. The process is implemented by a CPU (Central Processing Unit) of the ECU 11 in synchronization with the TDC signal pulse. In step S11, an IGMAPIN map is searched in accordance with the engine revolution number NE and the inlet pipe absolute pressure PBA, so that a basic ignition timing IGMAPIN of the intake ignition plugs 8I is calculated. Next, it is judged whether or not the operation state of the engine is in a phase-difference ignition region indicated by downward-sloping hatches in FIG. 6, i.e., a predetermined operating region where the ignition timings of the intake ignition plugs 8I are to be different from those of the exhaust ignition plugs 8E (step S12). In FIG. 6, predetermined inlet pipe absolute pressures PBA2, PBA3, and PBA4 are set to, for example, 48 kPa (360 mmHg), 74.7 kPa (560 mmHg), and 101.3 kPa (760 mmHg), and predetermined engine revolution numbers NE1, NE2, and NE3 are set to, for example, 1,000 rpm, 1,500 rpm, and 4,500 rpm, respectively.

When the operation state of the engine is in the phase-difference ignition region, an IGMAPEX map is searched in accordance with the engine revolution number NE and the inlet pipe absolute pressure PBA, and a basic ignition timing IGMAPEX of the exhaust ignition plugs 8E is calculated (step S13), and the control then proceeds to step S15. The IGMAPEX map is set only for the phase-difference ignition region, and the set values in the map are set to lag with respect to those in the IGMAPIN map in the same operation state.

Figure 7:
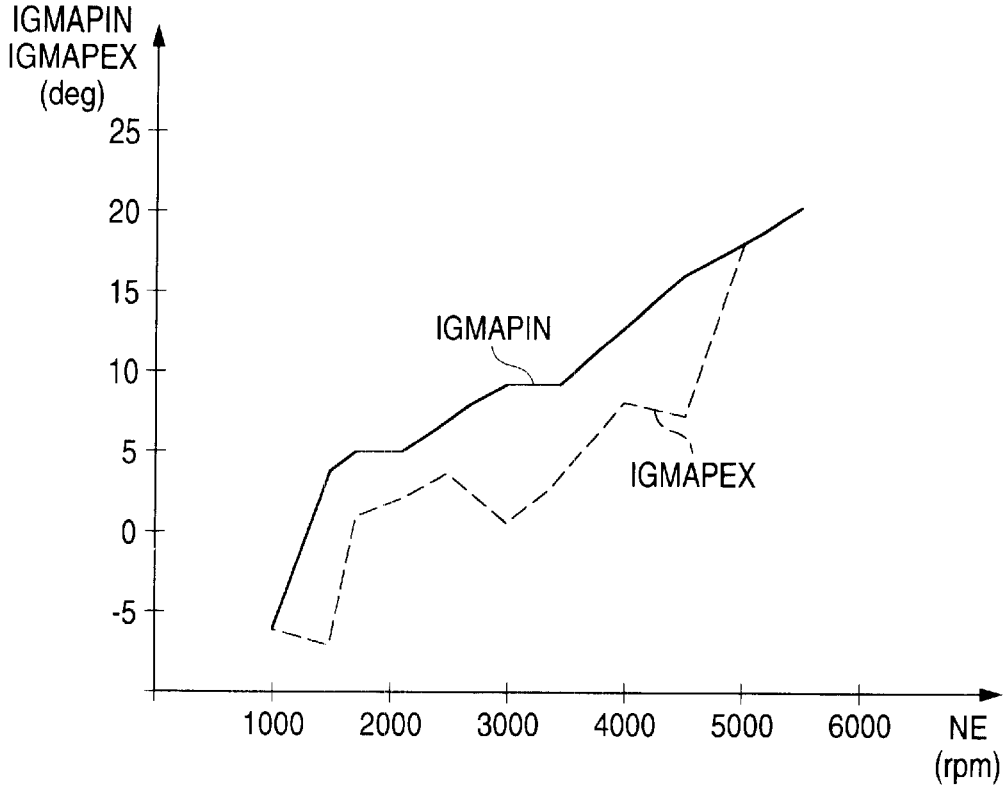
FIG. 7 is a view showing an example of setting of a map for calculating the ignition timings.

FIG. 7 is a view showing an example of relationships between the engine revolution number NE and the set map values of IGMAPIN and IGMAPEX in the case where the inlet pipe absolute pressure PBA is constant. In the range of 1,500 to 4,500 rpm of the engine revolution number NE, the basic exhaust ignition timing IGMAPEX is set to lag.

By contrast, when the operation state of the engine is in the operation range other than the phase-difference ignition region (the region indicated by upward-sloping hatches in FIG. 6), the basic exhaust ignition timing IGMAPEX is set as the basic intake ignition timing IGMAPIN which is calculated in step S11, and the control then advances to step S15.

In step S15, a correcting term IGCR is calculated in accordance with the temperature of the engine or the like. Then, intake ignition timing IGLOGIN and exhaust ignition timing IGLOGEX are calculated by adding the correcting term to the basic ignition timings IGMAPIN and IGMAPEX (step S16).

Based on the thus calculated ignition timings IGLOGIN and IGLOGEX, the ignition signals SIG1 to SIG4 are generated, and then supplied to the ignition plugs 8.

As described above, in the embodiment, the operating region where simultaneous ignition in which the ignition timings IGLOGIN and IGLOGEX of the two ignition plugs disposed in one cylinder, i.e., intake and exhaust ignition plugs 8I and 8E are equal to each other is to be performed, and the operating region where the phase-difference ignition is to be performed are set. Only when the operation state of the engine is in the phase-difference ignition region, the IGMAPEX map is searched, and, when the operation state is in the operating region where simultaneous ignition is to be performed, the map search is not performed, and the basic exhaust ignition timing IGMAPEX is set as the basic intake ignition timing IGMAPIN. In other words, the phase-difference ignition is performed only in the operating region where the effect of the phase-difference ignition is remarkably achieved. Therefore, the calculation load on the CPU of the ECU 11 can be reduced, and also the capacity of a memory required for storing the IGMAPEX map can be reduced.

Next, effects which are attained by implementing the phase-difference ignition will be described in detail with reference to FIGS. 8 and 9.

Figure 8:
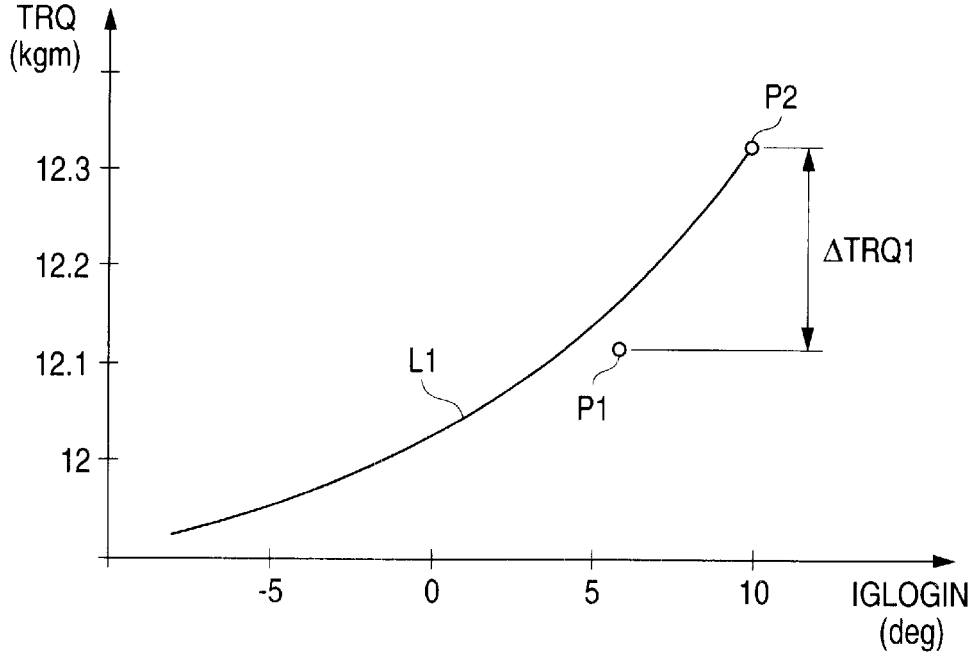
FIG. 8 is a view illustrating suppression of knocking due to the phase-difference ignition, and increase of the engine output.

FIG. 8 is a view showing relationships between the intake ignition timing IGLOGIN and the output torque TRQ of the engine, in case that the engine revolution number NE is 2500 rpm and the operation state is in the full throttle. In the figure, the line L1 shows characteristics in the case where the exhaust ignition timing IGLOGEX is optimumly set in accordance with the basic intake ignition timing IGLOGIN, and the point P2 is an operating point which corresponds to the case where IGLOGIN=10 deg. and IGLOGEX=3 deg. are set, and at which, when the phase-difference ignition is performed, the maximum output torque is obtained. By contrast, the point P1 is an operating point which corresponds to the knock limit in the case where the simultaneous ignition is performed (IGLOGIN =IGLOGEX=6 deg.) (i.e., an operating point where the output torque is maximum without causing knocking). In this example, when the phase-difference ignition is performed, the engine output torque can be increased by ΔTRQ1=0.2 kgm without causing knocking, because knocking can be prevented from occurring by performing the phase-difference ignition, as described later.

An air-fuel mixture flows into the combustion chamber 3 of the engine 1 in the direction of the arrow X in FIG. 2, to cause a clockwise swirl therein. When ignition by the intake ignition plug 8I1 is first performed, combustion proceeds from the vicinity of the ignition plug 8I1 toward the exhaust ignition plug 8E1. The ignition of the exhaust ignition plug 8E1 is performed after one of the intake ignition plug 8I1 so that normal combustion can be done before abnormal ignition of a so-called end gas part occurs (before knocking is caused). Therefore, the ignition timing at which the engine output torque is maximum can be set without causing knocking.

FIGS. 9A to 9D are views illustrating a phenomenon that, when the phase-difference ignition is performed, a maximum of the rate of change dP/dθ of the cylinder pressure PCYL can be made smaller than that in the case of the simultaneous ignition (the operation state is in the full throttle condition of NE=3,000 rpm). In the figures, the solid lines indicate characteristics in the phase-difference ignition (IGLOGIN=10 deg. and IGLOGEX=3 deg.), and the broken lines indicate those in the simultaneous ignition (IGLOGIN= IGLOGEX=8 deg.).

Figure 9A:
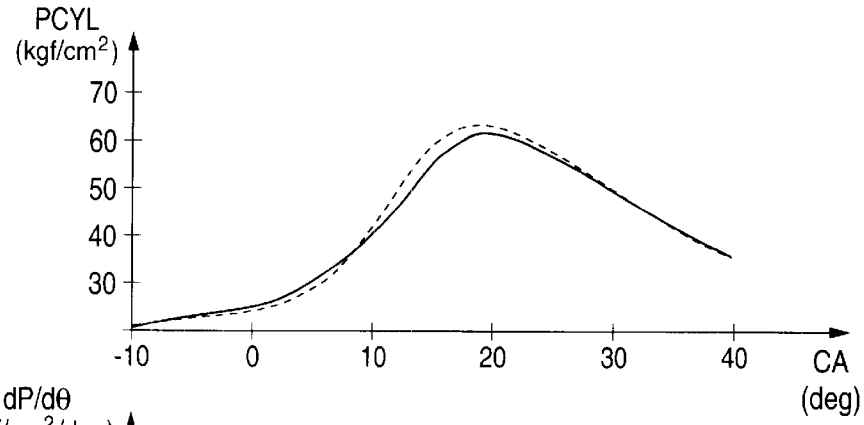
FIGS. 9A to 9D are views illustrating reduction of the maximum rate of change ($dP/d\theta MAX$) of the cylinder pressure due to the phase-difference ignition, and increase of the engine output caused by the reduction.
Figure 9B:
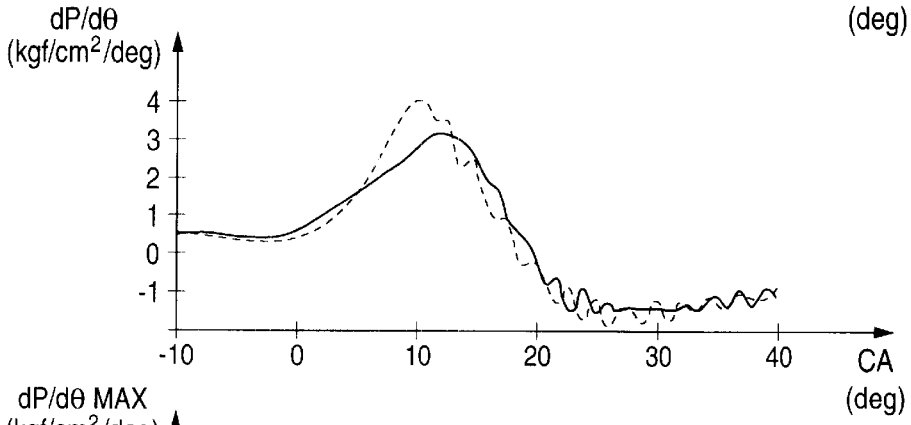
Figure 9C:
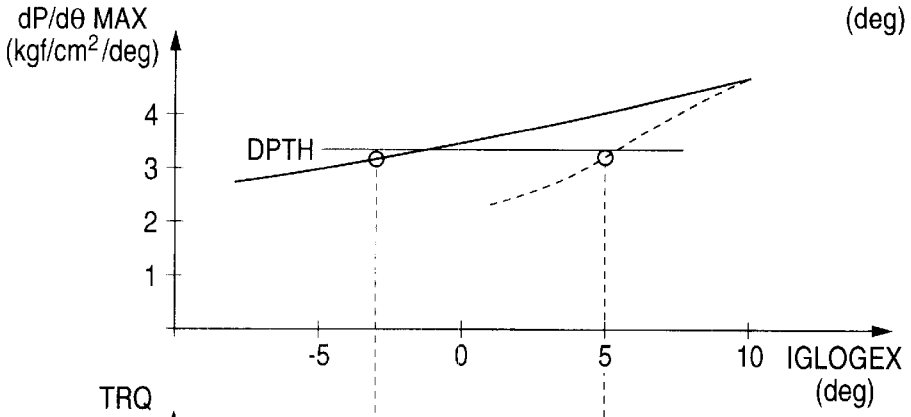
Figure 9D:
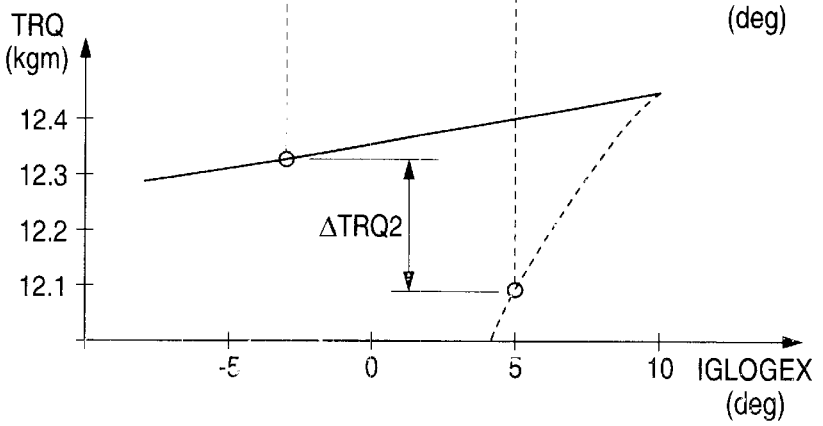

As shown in FIG. 9A, with respect to the cylinder pressure PCYL, the characteristics are approximately equal to each other. By contrast, as shown in FIG. 9B, the maximum dP/dθMAX of the rate of change dP/dθ in the phase-difference ignition is smaller than that in the simultaneous ignition. The solid line in FIG. 9C shows relationships between the basic exhaust ignition timing IGLOGEX and the maximum rate of change dP/dθMAX in the case where the intake ignition timing IGLOGIN is fixed to 10 deg., and the solid line in FIG. 9D shows relationships between the exhaust ignition timing IGLOGEX and the engine output torque TRQ in the case of the same setting. The broken lines in FIGS. 9C and 9D show relationships between the exhaust ignition timing IGLOGEX, and the maximum rate of change dP/dθMAX and the engine output torque TRQ in the case of IGLOGIN=TGLOGEX.

In an engine, vibration noises are higher in level as the maximum rate of change dP/dθMAX is larger. When the maximum rate of change dP/dθMAX is suppressed to the threshold DPTH of FIG. 9C or less, for example, the engine output torque in the phase-difference ignition can be therefore increased by ΔTRQ2 as compared with that in the simultaneous ignition.

When the phase-difference ignition is performed, moreover, the air-fuel ratio can be set to a leaner value, so that the fuel consumption can be improved and the amount of exhaust gas recirculation can be increased. Therefore, it is possible to attain also an effect that exhaust emission characteristics are improved.

In the embodiment, the ECU 11 constitutes an ignition timing control device.

The invention is not restricted to the embodiment described above, and may be variously modified. In the embodiment, when the phase-difference ignition is to be performed, the intake ignition timing IGLOGIN is set to lead the exhaust ignition timing IGLOGEX. The invention is not restricted to this timing relationship. Alternatively, the exhaust ignition timing IGLOGEX may be set to lead the intake ignition timing IGLOGIN. In the alternative also, the knocking suppressing effect can be attained by setting the intake ignition timing IGLOGIN so that ignition is performed before abnormal ignition of an end gas part occurs.

In the embodiment described above, the configuration (FIG. 3) in which the two ignition plugs are driven by the one ignition signal is employed. Alternatively, a configuration in which an ignition signal is generated for each of ignition plugs and the ignition plugs are driven respectively by the ignition signals may be employed.

As described above in detail, according to the invention, in the predetermined operating region which is determined on the basis of the rotational speed and load of the engine, the two ignition plugs ignite at different ignition timings. And, in the operating region other than the predetermined operating region, the ignition plugs ignite at the same ignition timing. When the predetermined operating region is restricted to a region where the effect of the setting of different ignition timings is remarkably achieved, therefore, the load on a calculation unit and the memory capacity can be reduced. In the predetermined operating region, an excellent effect of suppressing knocking and vibration noises can be attained by the setting of different ignition timings.

What is claimed is:

1. An ignition timing control device for controlling an ignition timing of an internal combustion engine in which two ignition plugs which perform at least one igniting operation in one cycle are disposed on an diagonal line of a combustion chamber of each cylinder, wherein said two ignition plugs ignite at different timings in an upper and lower bounded pre-determined phase-difference operating region within a rotational speed and an inlet pipe pressure map, and ignite at the same ignition timing in an operating region other than the predetermined phase-difference operating region.

2. The ignition timing control device according to claim 1, wherein the cylinder is divided into an intake side and an exhaust side, and said two ignition plugs are placed in the intake side and the exhaust side, respectively.

3. The ignition timing control device according to claim 1, wherein the map includes a load of the engine.

* * * * *